United States Patent [19]

Newland

[11] 4,304,522

[45] Dec. 8, 1981

[54] TURBINE BEARING SUPPORT

[75] Inventor: Allan B. Newland, St. Lambert, Canada

[73] Assignee: Pratt & Whitney Aircraft of Canada Limited, Longueuil, Canada

[21] Appl. No.: 112,346

[22] Filed: Jan. 15, 1980

[51] Int. Cl.[3] ..... F01D 25/16

[52] U.S. Cl. ..... 415/135; 415/142

[58] Field of Search ..... 60/39.32; 415/134, 136, 415/138, 142, 170 R, 135

[56] References Cited

U.S. PATENT DOCUMENTS

| | | | |
|---|---|---|---|
| 2,922,278 | 1/1960 | Szydlowski | 60/39.36 |
| 3,250,512 | 5/1966 | Petrie | 415/135 |
| 3,261,587 | 7/1966 | Rowley | 415/138 |
| 4,034,560 | 7/1977 | Chute | 415/142 |
| 4,245,951 | 1/1981 | Minnich | 415/170 R |

FOREIGN PATENT DOCUMENTS

| | | | |
|---|---|---|---|
| 523543 | 4/1956 | Canada | 415/138 |

*Primary Examiner*—Douglas Hart
*Attorney, Agent, or Firm*—Fleit & Jacobson

[57] ABSTRACT

A gas turbine engine comprising an annular casing and a bearing housing located concentrically with the casing and in spaced relation thereto. An annular exhaust gas duct is formed between the bearing housing and the outer annular casing. The bearing housing includes a pair of concentric spaced-apart rings connected in a cantilevered manner. The outer ring is supported to the outer casing by angularly, spaced-apart, radially extending support members, and the inner ring includes a cylindrical inner surface to which a concentric bearing support member is tightly fitted therein. The concentric bearing support member includes angularly, spaced-apart, support contact means tightly engaging the inner cylindrical surface of the inner ring while the remainder of the bearing support is out of radial contact with the inner ring of the housing to allow for minimum thermal conduction, yet stressed for relief in the tightly fitting support member within the bearing support housing.

4 Claims, 3 Drawing Figures

12
12
52
14
28
44
44
34
42
40
16,30
40a
50
50
40a
40
44
44
46
50
28
44
44
28
42
34

TURBINE BEARING SUPPORT

BACKGROUND OF THE INVENTION

1. Field of the Invention

The present invention relates to a gas turbine engine, and more particularly, to the support for a bearing in the turbine portion of the engine, downstream of the combustion chamber.

2. Description of the Prior Art

Such supports are by the nature of their location subject to thermal differentiation. For example, in a typical gas turbine engine, the bearing supports in the so-called hot portion of the engine, include radially extending tension rods or fairings attached to the outer casing and passing through the annular gas exhaust duct to engage a bearing support housing centrally of the engine. The fairings which pass through the annular exhaust gas passage and the inner casing are, of course, subjected to very high temperatures while the bearings per se are usually in a bath of cooling medium. The bearing support is a structural intermediate between these two thermal extremes. The bearing support must also be capable of compensating for radial thermal expansion due to the higher temperatures of the parts near the annular exhaust gas passages and much less radial expansion of the parts near the cooler bearing region.

It is customary to assemble the bearing support parts with a very tight radial fit such that they will still maintain their position under hot conditions. It is also known to provide radial dowels or pins to allow for radial expansion and thus loosening of the parts without loss of structural stability.

U.S. Pat. No. 2,829,014, H. May, issued Apr. 1, 1958 to United Aircraft Corporation, suggests the use of a spring ring intermediate between the bearing support rods which pass through the exhaust gas path and which are supported by the outer casing and the bearing support. The points of contact between the spring ring and the above element are staggered.

U.S. Pat. No. 2,928,648, Haines et al, issued in 1960 to United Aircraft Corporation, describes tension rods extending directly from the bearing housing to the outer casing and any radial resilience is obtained from the outer casing.

SUMMARY OF THE INVENTION

It is an aim of the present invention to provide an improved bearing support structure which is light and inexpensive, yet allows maximum radial resilience to compensate for differing thermal expansions.

It is also an aim of the present invention to provide an easily assembled bearing support which will have minimal circumferential contact with the bearing housing wall, yet will have great radial resilience.

A turbine construction in accordance with the present invention comprises an annular casing, a bearing housing located concentrically within the casing and in spaced relation thereto, the bearing housing including a pair of concentric spaced-apart rings connected in a cantilever manner, the pair of rings including an outer ring supported directly by spaced-apart, radially extending, support members to the outer casing, and an inner ring including a cylindrical inner surface, a concentric bearing support member provided within said bearing housing and including angularly, equally spaced-apart support contact means tightly engaging said inner cylindrical surface of the inner ring of said bearing housing such that the inner ring may be subject to circumferential distortions, thus absorbing the stresses of the fit between the bearing support and the inner ring.

In a more specific construction of the present invention, the bearing support includes an outer ring member on which are provided three circumferentially, equally spaced-apart, radially projecting support contact means adapted to tightly engage the cylindrical inner surface of the inner ring of the bearing housing and the bearing support includes an outer bearing race member and connecting means fixedly connecting the outer race member to the outer ring of the bearing support in a cantilever manner.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 1:
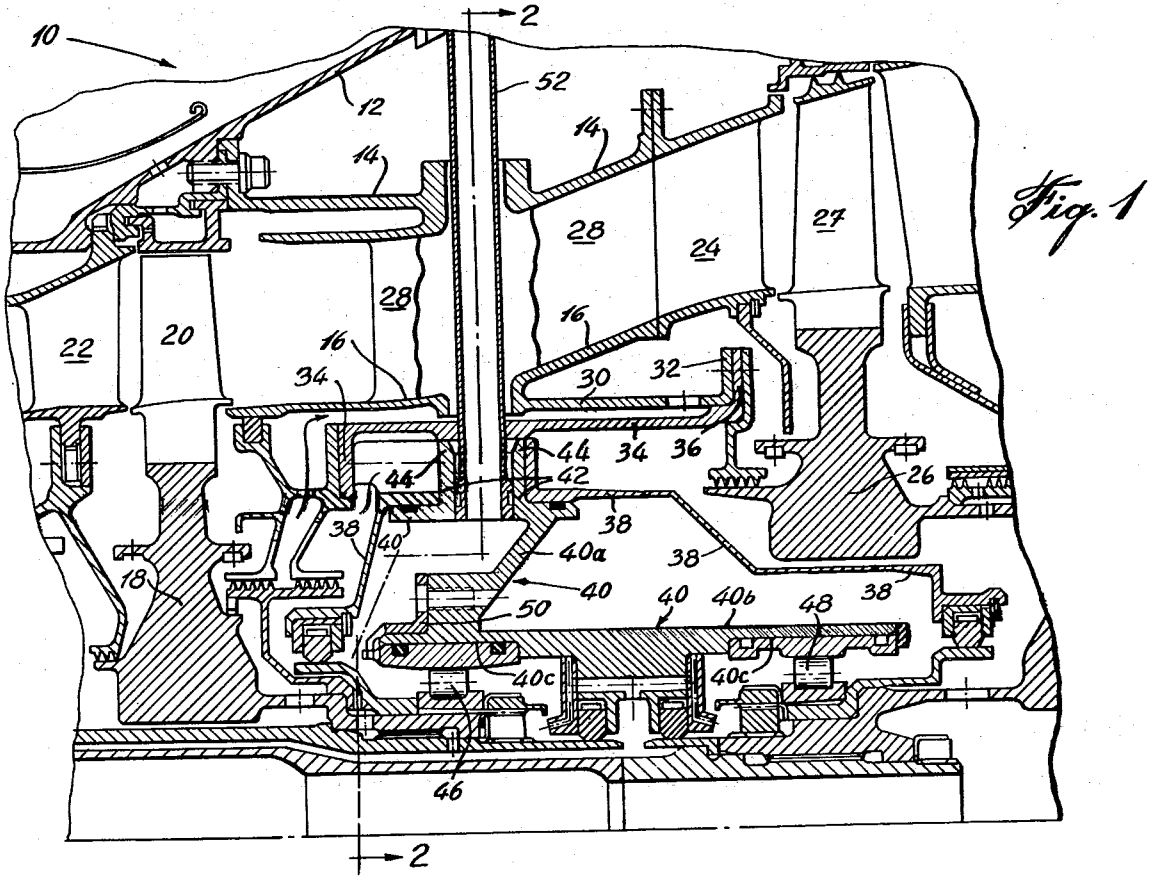
FIG. 1 is a fragmentary axial cross-section of a detail of an embodiment of a gas turbine engine.
Figure 2:
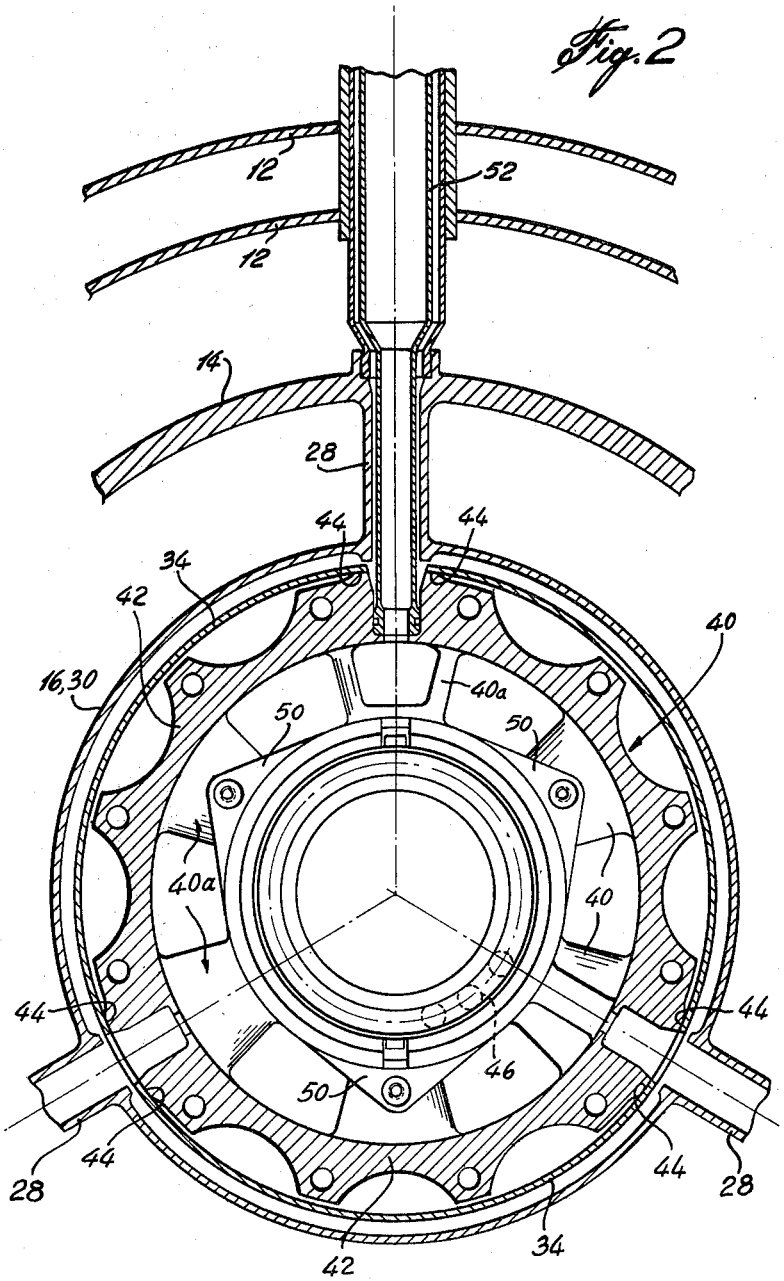
FIG. 2 is a radial cross-section taken along line 2—2 of FIG. 1.

The gas turbine engine 10 is shown partially in cross-section in FIG. 1. The portion of the gas turbine engine shown in FIG. 1 includes the exhaust path of the hot gases coming from the combustion chamber as well as the turbine sections in that gas path. In the embodiment shown in the drawings, an outer casing 12 is illustrated to which the annular, exhaust gas duct, outer wall 14 is rigidly fixed. Similarly, an inner exhaust gas duct wall 16 is spaced concentrically inwardly of the outer wall 14 and is connected to the outer wall by means of stator vanes 24 and the fairings 28. As shown in FIG. 2, there are three fairings 28 equally spaced about the periphery of the inner wall 16. The fairings 28 are essentially the structural mountings for the inner wall 16 and the remainder of the concentric structure which will be discussed later.

Turbine rotors 18 and 26 are illustrated, mounting respectively turbine blades 20 and 27.

The inner wall 16 of the annular exhaust gas duct mounts an axially extending annular deflector ring 30 having a radially extending flange 32. The bearing support housing 34 is mounted concentrically of the deflector ring 30 and is parallel thereto and includes a radially extending flange 36 which is fixed to the flange 32.

An annular oil case shell 38 is mounted within the bearing support housing wall 34.

A bearing support 40 having a scalloped continuous ring 42 is provided within the support housing wall 34 and is in contact with the wall 34 at contact rim surfaces 44 in line with the fairings 28. The scalloped radial protrusions of the ring 42 are not meant to contact the housing wall 34 and are, therefore, spaced inwardly therefrom. The contact rims 44 of this ring 42 are tightly fitted within the cylindrical surface provided by the wall 34, and because the protrusions of the ring 42 other than the contact rim 44 are spaced inwardly radially, the wall 34 may even be allowed to be distorted from a true circle as a result of the stress of the tight fit of the contact rims 44. It is seen from this particular arrangement that the ring 42 will be reasonably easily fitted within the housing wall 34 as the actual tight fit is only at three spaced-apart contact areas on the inside of the wall 34, and since the wall 34 does not have a direct radial support but is cantilevered by means of the flange connections 36 and 32 with the deflector ring 30, then the wall 34 has a certain flexibility in the radial direction.

It is also noted that the tight fit of the contact rim 44 of the ring 42, distorting the wall 34, compensates for the expansion of the wall 34 radially since as the wall 34 is expanded to a greater degree than the ring 42, stresses in the wall 34 will be reduced, eliminating the distortion, but the contact rim 44, it is believed, will still be in contact with the respective portions of the wall 34.

The support member 40 includes angled spoke members 40*a* which are connected to the cylindrical portion 40*b* of the bearing support which define the bearing race seats 40*c*. Bearing assemblies 46 and 48 are provided in the respective bearing seats 40*c*, as shown in FIG. 1. A flanged cover member 50 is fixed to the bearing support 40, as shown in FIGS. 1 and 2, to hold the bearings against axial movement.

It is noted that access pipes 52 are connected for supplying oil to the bearings, the pipes 52 passing through hollowed-out portions of the fairings 28 and centrally of the contact rims 44 of the bearing support 40.

Figure 3:
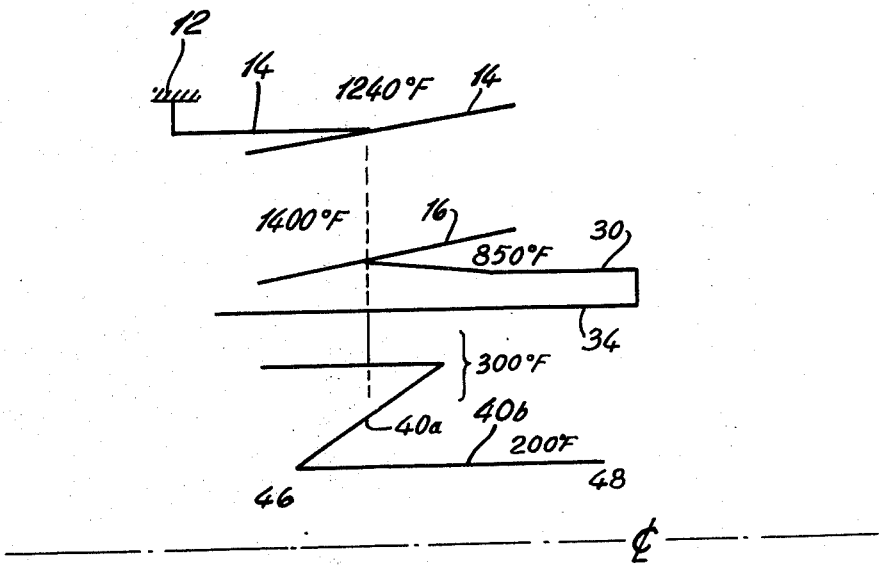
FIG. 3 is a schematic diagram showing a typical temperature gradient in the area of the bearing support.

As can be seen from the structure, there is substantial flexibility in the radial direction allowing different thermal expansions of the parts. Of course, the bearing area, as shown in FIG. 3, is typically in the 200° F. range as it is cooled and kept in an oil bath, while the other extreme, that is, the fairing 28 is caused to have a typical temperature of 1400° F. as it is provided right in the gas exhaust duct. The temperature gradient at the cylindrical scalloped ring 42 may be in the 300° F. range, while the deflector ring 30 may have a temperature of 850° F. Accordingly, the rings 42 have minimal radial expansion movement compared to the deflector ring 30 and certainly compared to the inner wall 16 of the gas duct and the fairing 28 which would be subjected to a considerably greater thermal radial expansion. This expansion is compensated for by the cantilevered mounting arrangement of the deflector ring 30 and the bearing support housing wall 34.

Furthermore, there is some flexibility in the cantilevered arrangement of the bearing support 40 itself, witness the angle of the spokes 40*a*. In addition to the improved assembling of the support ring 42 in the housing wall 34, the amount of thermal conduction from the housing 34 through the support ring 42 of the bearing support 40 is reduced to a minimum since only the contact rims 44 are in direct contact with the housing wall 34.

I claim:

1. In a gas turbine engine, an annular casing, a bearing housing located concentrically within the casing and in spaced relation thereto, the bearing housing including a pair of concentric spaced-apart rings connected in a cantilevered manner, the pair of rings including an outer ring supported directly by angularly spaced-apart, radially extending support members to the outer casing, and an inner ring including a cylindrical surface, a concentric bearing support member provided within said bearing housing and including angularly, equally spaced-apart support contact means tightly engaging said inner cylindrical surface of the inner ring of said bearing housing such that the inner ring may be subjected to circumferential distortions, thus absorbing the stresses of the fit between the bearing support and the inner ring.

2. In a gas turbine engine as defined in claim 1, wherein the bearing support includes an outer ring member on which are provided three circumferentially, equally spaced-apart, radially projecting support contact means adapted to tightly engage the cylindrical inner surface of the inner ring of the bearing housing, and the bearing support includes an outer bearing race member seat and connecting means fixedly connecting the outer race seat member to the outer ring of the bearing support in a cantilevered manner.

3. In a gas turbine engine as defined in claim 1, wherein the outer casing includes an annular exhaust gas duct defined between an outer duct wall and an inner duct wall, the inner duct wall being connected in a cantilevered manner to the outer ring of the bearing housing, and the angularly spaced-apart, radially extending support members being directly fixed to the inner duct wall.

4. In a gas turbine engine as defined in claim 3, wherein the spaced-apart support contact means includes a rim surface radially aligned with the angularly spaced-apart, radially extending support members, the cantilevered structure of the connections between the inner and outer rings of the bearing support housing allowing for radial differential expansion between the exhaust gas duct walls and the bearing support member.

* * * * *